US012312113B2

(12) United States Patent
Toro

(10) Patent No.: US 12,312,113 B2
(45) Date of Patent: May 27, 2025

(54) PACKAGING MACHINE

(71) Applicant: SYSTEM CERAMICS S.P.A., Fiorano Modenese (IT)

(72) Inventor: Andrea Toro, Fiorano Modenese (IT)

(73) Assignee: SYSTEM CERAMICS S.P.A., Fiorano Modenese (IT)

( * ) Notice: Subject to any disclaimer, the term of this patent is extended or adjusted under 35 U.S.C. 154(b) by 2 days.

(21) Appl. No.: 18/249,481

(22) PCT Filed: Nov. 17, 2021

(86) PCT No.: PCT/IB2021/060643
§ 371 (c)(1),
(2) Date: Apr. 18, 2023

(87) PCT Pub. No.: WO2022/107010
PCT Pub. Date: May 27, 2022

(65) Prior Publication Data

US 2023/0391485 A1 Dec. 7, 2023

(30) Foreign Application Priority Data

Nov. 17, 2020 (IT) ..... 102020000027534

(51) Int. Cl.

| | |
|---|---|
| ***B65B 11/58*** | (2006.01) |
| ***B65B 13/18*** | (2006.01) |
| ***B65B 23/20*** | (2006.01) |
| ***B65B 41/04*** | (2006.01) |
| ***B65D 71/00*** | (2006.01) |
| ***B65D 81/05*** | (2006.01) |

(Continued)

(52) U.S. Cl.
CPC ..... *B65B 41/04* (2013.01); *B65B 13/181* (2013.01); *B65B 23/20* (2013.01); *B65D 71/0085* (2013.01); *B65D 81/054* (2013.01); *B65D 85/46* (2013.01); *B65D 85/62* (2013.01)

(58) Field of Classification Search
CPC ..... B65B 13/181; B65B 9/135; B65B 11/02; B65B 11/585; B65B 61/22
USPC ..... 53/139.7
See application file for complete search history.

(56) References Cited

U.S. PATENT DOCUMENTS 3,271,925 A * 9/1966 Aubery ..... B29B 7/566 53/589
3,942,686 A * 3/1976 Roth ..... B65B 51/02 91/275

(Continued)

FOREIGN PATENT DOCUMENTS

| | | |
|---|---|---|
| DE | 2431153 A1 | 1/1976 |
| EP | 0089533 A1 | 9/1983 |
| EP | 0538148 A1 | 4/1993 |

*Primary Examiner* — Thanh K Truong
*Assistant Examiner* — Patrick B Fry
(74) *Attorney, Agent, or Firm* — Chrisman Gallo Tochtrop LLC

(57) ABSTRACT

A packaging machine comprising:
a rest plane (2) for a pack (C) of products (P);
at least one magazine (3), predisposed to contain one or more connecting elements (A), predisposed to be applied to at least one flank (S) of the pack (C);
at least one applicator (4), movable between at least one pick up position, in which it is able to pick up a connecting element (A) from the magazine (3), and at least one application position, in which it is able to position a connecting element (A) in contact with a flank (S) of the pack (C).

14 Claims, 7 Drawing Sheets

(51) Int. Cl.
*B65D 85/46* (2006.01)
*B65D 85/62* (2006.01)

(56) References Cited

U.S. PATENT DOCUMENTS

| | | | | | |
|---|---|---|---|---|---|
| 5,226,280 | A * | 7/1993 | Scherer | B65B 13/181 | 221/211 |
| 5,546,730 | A * | 8/1996 | Newell | B65B 11/585 | 53/399 |
| 5,564,254 | A * | 10/1996 | Thimon | B65B 13/181 | 53/410 |
| 6,508,044 | B2 * | 1/2003 | Suolahti | B65B 13/181 | 414/797 |
| 7,213,381 | B2 * | 5/2007 | Zitella | B65B 13/181 | 53/139.7 |
| 2016/0152363 | A1 * | 6/2016 | Termanas | B65B 13/181 | 53/410 |

* cited by examiner

PACKAGING MACHINE

The present invention relates to a packaging machine and a method for packaging packs formed by products.

In particular, the invention relates to the packaging of packs having a parallelepiped shape, formed by products superposed on or stacked on one another.

Packs having these characteristics are commonly realised in the industry of ceramic slab production, especially ceramic slabs having large dimensions, up to 2×4 metres.

At the end of the production line, the slabs are boxed, using known methods and plants, into boxes containing from 2 to 5 products. A certain number of these boxes are then stacked on one another, vertically or horizontally, to form a pack having overall a substantially parallelepiped shape.

Each box of ceramic slabs has two main surfaces or faces, parallel to one another, and four lateral surfaces or flanks, lying on planes that are substantially perpendicular to the faces, which extend along the perimeter of the faces and join the faces to one another.

The various boxes are arranged stacked or superposed on one another at the faces thereof, with the flanks arranged substantially aligned and coplanar with respect to one another, so as to form a pack that has two faces, defined respectively by the upper face of the product that is topmost in the stack and by the lower face of the product that is bottom-most in the stack, and four flanks, formed by the flanks of the products that are superposed or stacked on one another. The boxes are bound to one another in such a way as to stabilise the pack.

The binding of the boxes forming the pack is typically realised by means of strapping machines, which tighten one or more straps about the pack, which bind the various boxes to one another. The removal of the straps frees all the boxes in the pack.

The packs structured in this way are delivered to the users and are typically arranged resting on one of the flanks. The boxes are then picked up one after another, starting from one of the boxes which are located at an end of the pack.

In these conditions, an issue arises of preventing the boxes which remain in the pack from tipping over, following the successive pick up of the boxes that are positioned on the outer side.

At present, the above-summarised drawback is obviated by a machine that is predisposed to bind the various boxes using straps that are arranged about the various boxes, binding each box to at least a box previously arranged in the pack. Briefly, the known machine operates in the following way.

A first box and a second box are deposited on a pallet and bound to one another by means of a first strap to form a pack. A third box is arranged on the pallet and bound to the other two by means of a second strap to form a pack composed of three boxes. A fourth box is arranged on the pallet and bound to the other three boxes by means of a third strap, to increase the number of boxes in the pack, and so on. To remove a box from the pack it is necessary to cut the strap which binds the box to the other boxes. The other boxes remain, however, bound to one another by means of the corresponding straps.

The known machine has some significant drawbacks. Firstly, a large consumption of straps is required, which are made of an expensive and not-recyclable material. Further, the packaging cycle of a pack is very slow and laborious, as it requires binding a strap for each box arranged in the pack.

A further drawback is given by the complex structure of strapping machines, which frequently leads to malfunctioning conditions thereof.

The aim of the present invention is to provide a packaging machine and a method for packaging packs formed by a certain number of products which enables the drawbacks of the currently available machines to be obviated.

An advantage of the present invention is that the products are bound to one another in a single step, enabling a significant reduction of the packaging times.

A further advantage of the present invention is that it can use connecting elements among the various products which are made of an economical or recyclable material, such as for example paper or cardboard.

Additional features and advantages of the present invention will become more apparent from the following detailed description of an embodiment of the invention, illustrated by way of non-limiting example in the appended figures, in which.

Figure 1:
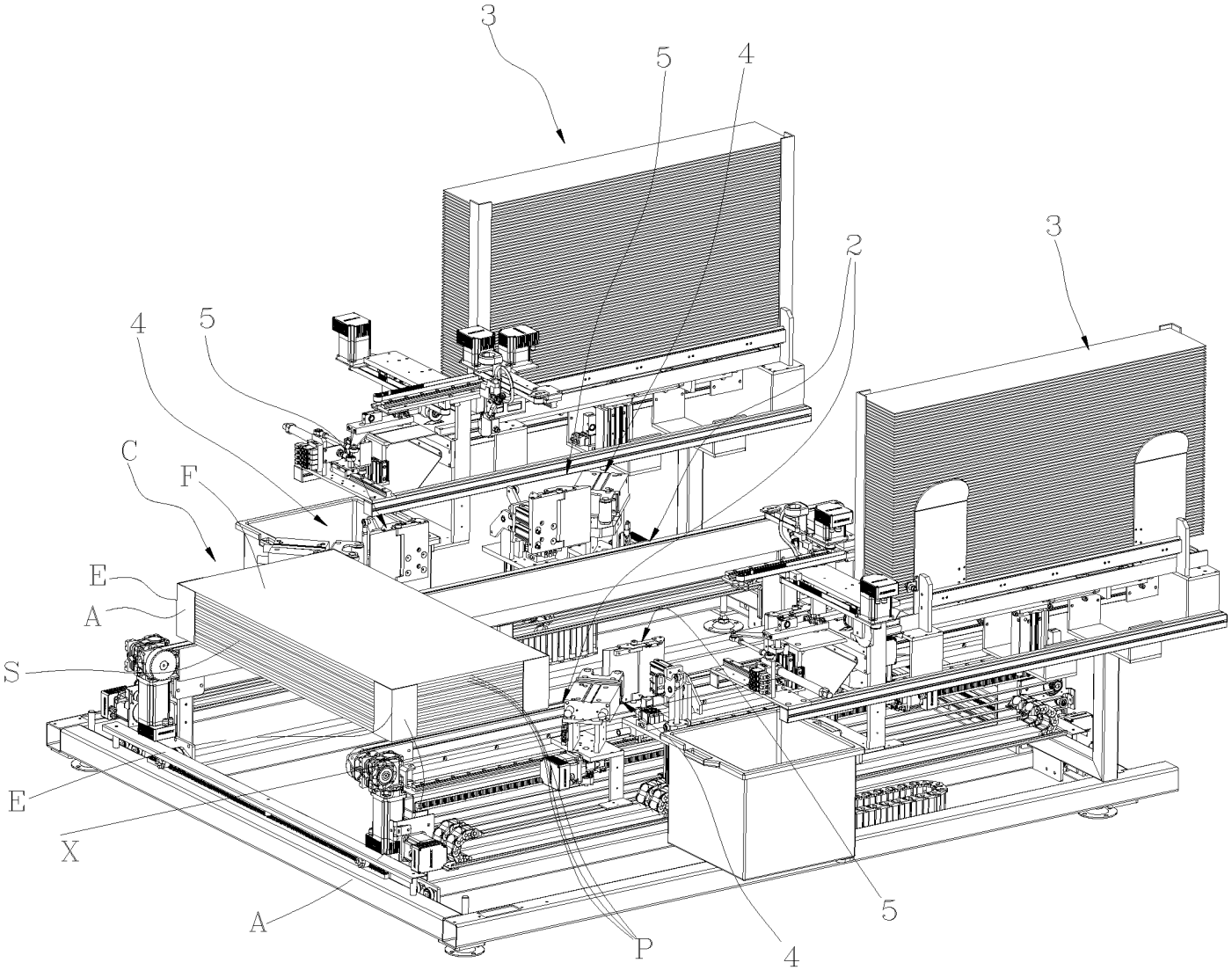
FIG. 1 is an overall isometric view of the machine according to the present invention.

The machine and method according to the present invention are especially useful for realising the packaging of products (P) having a substantially parallelepiped shape.

By "product having a substantially parallelepiped shape" is meant a product (P) which has two main surfaces or faces (F), parallel to one another, and four lateral surfaces or flanks (S), lying on planes that are substantially perpendicular to the faces (F), which extend along the perimeter of the faces and join the faces to one another.

Products that are particularly suitable to be packaged with the machine and the method according to the present invention are in the form of quadrangular, rectangular or square slabs, which have two main surfaces or faces (F), having a larger area, parallel to one another, and four lateral surfaces or flanks (S), substantially perpendicular to the faces and having a smaller area with respect to the faces, which extend along the perimeter of the faces and join the faces to one another. The distance between the faces of the product is much smaller than the lengths of the sides of the faces.

Products having the above-summarised characteristics can also be in the form of boxes, previously formed, which, for example, contain a certain number of ceramic slabs or tiles stacked on one another.

The machine and the method according to the present invention are particularly predisposed to constrain the products (P) arranged stacked or superposed to one another at the faces (F) thereof, with the flanks (S) arranged substantially aligned and coplanar with respect to one another.

The products (P) thus arranged form substantially a pack (C) which has two faces (F), defined respectively by the upper face of the product (P) that is topmost in the stack and by the lower face of the product (P) that is bottom-most in the stack, and four flanks (S), formed by the flanks (S) of the products (P) that are superposed or stacked on one another. Two adjacent flanks (S) conjoin in corners (E), substantially perpendicular to the faces (F).

Corners (E) are defined at the junctions between the faces (F) and each of the flanks (S).

In the following part of the description, the term flanks (S) can be used to indicate both the flanks (S) of a product (P), and the flanks (S) of a pack of products (P). In the same way, the term faces (F) can be used to indicate both the faces (F) of a product and the faces (F) of a pack of products.

The packaging machine of the present invention comprises a rest plane (2) for a pack (C) of products (P). The rest plane (2) is preferably horizontal. In the illustrated embodiment, the rest plane (2) is motorised, in order to translate the packs (C) along a transport direction (X). This enables conveying the packs (C) in succession to the machine, and at the same time evacuating the already-packaged packs (C) one after another. In the illustrated preferred but not exclusive embodiment, the rest plane (2) is defined by a pair of motorised belts (21), parallel to the transport direction (X).

The machine according to the present invention further comprises at least one magazine (3), predisposed to contain one or more connecting elements (A), predisposed to be applied to at least one flank (S) of the pack (C).

In a preferred, not exclusive embodiment, the connecting elements (A) are in the form of strips of flexible material, for example paper or cardboard, plastic or rubber materials or others.

In general, the connecting elements (A) are made of a suitable material to be fixed to a flank (S) of the pack (C), for example by gluing. In particular, the connecting element (A) is constrained to all the products (P) that form the pack (C), i.e. it is constrained to the coplanar flanks (S) of all the products (P) that form the pack (C). For this purpose, it is possible to use a layer of glue applied in a determined zone of the connecting element (A) and/or on the flanks (S) of the products (P), in such a way as to cover the flanks (S) of all the products (P).

The magazine (3) is structured to contain a certain number of connecting elements (A) superposed on one another in a flat configuration to form a pack that extends substantially vertically. The orientation of the magazine (3) is however not relevant to the purposes of the present invention. For example, the magazine (3) might be orientated diagonally with respect to the vertical, or might be orientated horizontally.

In the illustrated embodiment, the magazine is formed by a plurality of bars connected to one another in order to delimit an internal space in which the connecting elements (A) can be housed.

The machine according to the present invention further comprises at least one applicator (4), movable between at least one pick up position, in which it is able to pick up a connecting element (A) from the magazine (3), and at least one application position, in which it is able to position the connecting element (A) in contact with at least one flank (S) of the pack (C).

In other terms, in the application position, the applicator (4) is able to arrange the connecting element (A), previously picked up, in contact with at least one flank (S), i.e. in contact with the flanks (S) of all the products (P) that form the pack (C). This enables fixing the connecting element (A) to the coplanar flanks (S) of all the products (P) that form the pack (C), for example by gluing, as already indicated.

The connecting element (A), fixed to a flank (S) of the pack (C), i.e. to the coplanar flanks (S) of all the products (P), enables stabilising the pack (C), and maintaining the products (P) united even if the pack (C) is positioned resting on a different flank with respect to the one on which the connecting element (A) has been applied, with the products (P) arranged on substantially vertical or slightly reclined planes with respect to the vertical.

If the connecting element (A) is made in a sectionable material, such as for example paper or cardboard, it is possible to pick up one product (P) at a time, by sectioning the corresponding portion of the connecting element (A), without compromising the stability of the other products (P), which remain joined to one another by the remaining portion of the connecting element (A).

The greater the distance of the connecting element (A) with respect to the flank (S) on which the pack (C) is rested, obviously the greater the stabilising effect is on the product.

In order to obtain a stabilising and binding effect of the products (P) which form the pack (C), it is sufficient for the connecting element (A) to be applied to the at least one flank (S) of the pack (C). Obviously, it is possible to apply several connecting elements (A) on the same flank (S) or on opposite or adjacent flanks. This enables binding and stabilising the products (P) in a more effective manner.

In the illustrated preferred but not exclusive embodiment, a connecting element (A) is applied straddling a corner (E) between two adjacent flanks (S) of the pack (C). A connecting element (A) is preferably applied straddling each corner of the pack (C). For this purpose, the machine is provided with four applicators (4), each of which works on a respective corner (E) of the pack (C). It would obviously be possible to use one applicator (4) alone, by causing the pack (C) to rotate so as to successively proffer the various corners (E) to the applicator (4), or two applicators, positioned in such a way as to operate on two flanks (S) that are opposite. In this case each applicator (4) can be made movable so as to be able to operate on the two corners (E) which are positioned on the corresponding side.

In the angular position described above, a connecting element (A) also has a protective function on the corner (E). By using a material having a suitable thickness and/or a suitable density, it is possible to protect the corners (E) in a very effective way, both for a pack formed by a plurality of products (P), and for a single product (P). Further, the angular positioning of the connecting elements (A), i.e. the straddling positioning of the corners (E), enables contemporaneously utilising traditional straps, which can be applied using a dedicated machine located upstream or downstream of the machine according to the present invention, with the connecting elements (A) applicable with the machine according to the present invention.

One or more connecting elements (A) might be applied straddling a corner (E) between a face (F) and a flank (S) of the pack (C). In this case, as well as extending onto the flank (S) of the pack (C), each connecting element (A) has at least a portion folded on a face (F), being arranged substantially in an L shape. It would also be possible to arrange one or more connecting elements (A) straddling two opposite corners (E) of a same flank (S). In this case, each connecting element (A) is arranged substantially in a C shape, with two end portions folded on the faces (F) of the pack and a central portion arranged on a flank (S).

The connecting elements (A), arranged as described above, can be used in a variable number and variable configurations, according to needs.

The machine can be provided with an applicator (4) for each connecting element (A), and/or one or more applicators (4) can be movable in order to position the connecting elements (A) in various positions and configurations.

The illustrated preferred but not exclusive embodiment comprises four applicators (4), each of which is predisposed to apply a connecting element (A). In particular, in the illustrated version each applicator (4) is predisposed to apply a connecting element (A) to a vertical corner (E) of the pack. In the following one applicator (4) alone will be described, but the description given of the applicator (4) is to be understood as valid also for the other applicators (4).

In a preferred but not exclusive embodiment of the machine, an applicator (4) comprises a gripping plate (5), provided with a gripping means activatable between a gripping configuration, in which it is able to retain a connecting element (A), and a release configuration, in which it is able to release the connecting element (A). The gripping means is not illustrated in detail, as it is known to the person skilled in the sector. For example, the gripping means comprises one or more openings, positioned on the gripping plate (5) connected to a suction circuit that, once activated, is able to retain the connecting element in contact with the gripping plate (5).

In the illustrated not exclusive embodiment, the gripping plate (5) is rotatable between a first position, in which the gripping means faces towards the magazine (3) and is able to grip and retain a connecting element (A), and a second position, in which the gripping means faces towards the pack (C).

This possibility of rotation of the gripping plate (5) enables positioning the magazine (3) more freely. In the illustrated embodiment in which the magazine (3) is orientated vertically, the first position of the gripping plate (5) is substantially a position in which the plate (5) is arranged horizontally, with the gripping means facing upwards. In this way, the connecting elements (A), which are housed horizontally in the magazine (3), i.e. arranged on horizontal planes, can be transferred to the gripping plate (5) very simply, without any need to undergo rotations in space.

In the second position, the gripping means face towards the pack (C), in order to allow the application of the connecting element (A) retained by the gripping means. In the illustrated embodiment the gripping plate (5), in the second position, is arranged substantially vertically, with the gripping means facing towards the pack (C). In this position, the connecting element (A) can be applied to the pack (C), in particular to at least one flank (S) of the pack (C). The rotation of the gripping plate (5) can be obtained using a motor means known to the person skilled in the sector, and for this reason not illustrated in detail.

In the illustrated preferred but not exclusive embodiment, the applicator (4) comprises a carriage (41), movable along a sliding direction which, for example, is parallel to the transport direction (X). The carriage (41) is movable between the first position, in which it is nearer to the magazine (3), and a second position, in which it is nearer to the rest plane (2), i.e. to the pack (C) in the working condition of the machine. In other embodiments, the sliding direction might be differently orientated. An actuator means known to the expert in the sector, comprising for example a motor and a sliding guide, is predisposed to cause the displacement of the carriage (41) between the pick up and the application positions. The actuator means has not been illustrated in detail.

The gripping plate (5) is associated to the carriage (41) and slides solidly therewith along the sliding direction.

In substance, the pick up position of the applicator (4) is defined when the carriage (41) and the gripping plate (5) are located in the respective first position. The application position of the applicator (4) is defined when the carriage (41) and the gripping plate (5) are located in the respective second position.

The gripping plate (5) is preferably movable between a distanced position, in which it is situated at a predetermined distance from the pack (C), and an approached position, in which it is substantially in contact with at least one flank (S) of the pack (C) and in which it is able to apply a connecting element (A) to at least one flank (S) of the pack (C). Moving from the distanced position to the approached position, the gripping plate (5) presses the connecting element (A) into contact with the pack (C), in a predetermined zone of at least one flank (S), enabling the application and fixing thereof, for example by gluing, as already indicated. The displacement between the distanced position and the approached position can be produced by means of an actuator of known type, for example a pneumatic cylinder, not described in detail as it is known to the expert in the sector. In the illustrated embodiment, the actuator of known type can be arranged on board the carriage (41).

In the illustrated preferred but not exclusive embodiment, the gripping plate (5) assumes the distanced and approached positions when it is in its second position.

Briefly, in the illustrated embodiment, the cycle of displacements performed by the applicator (4) is as follows.

Figure 2:
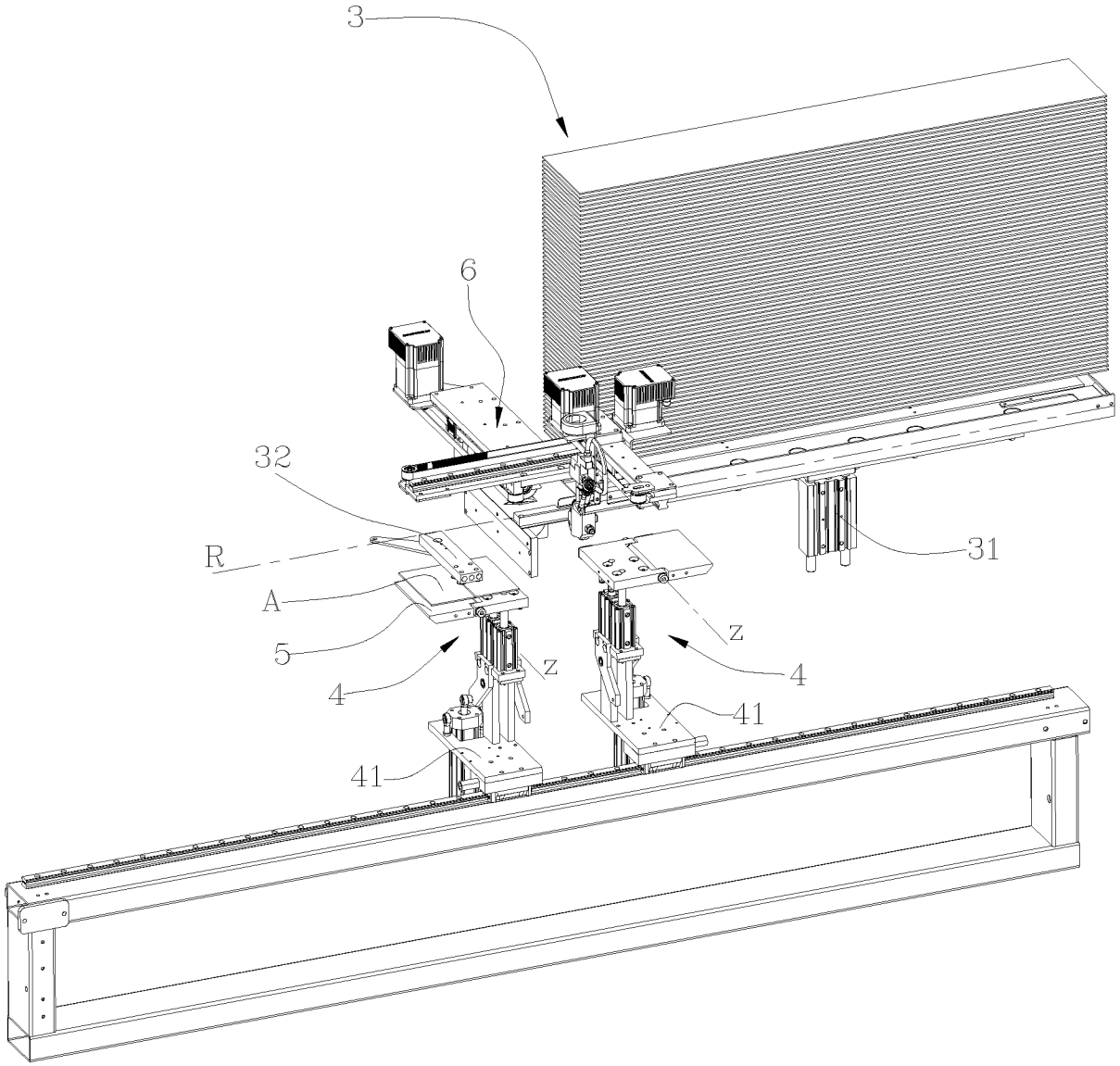
FIG. 2 shows a partial view of the machine of FIG. 1, in order to illustrate some components in greater detail.
Figure 3:
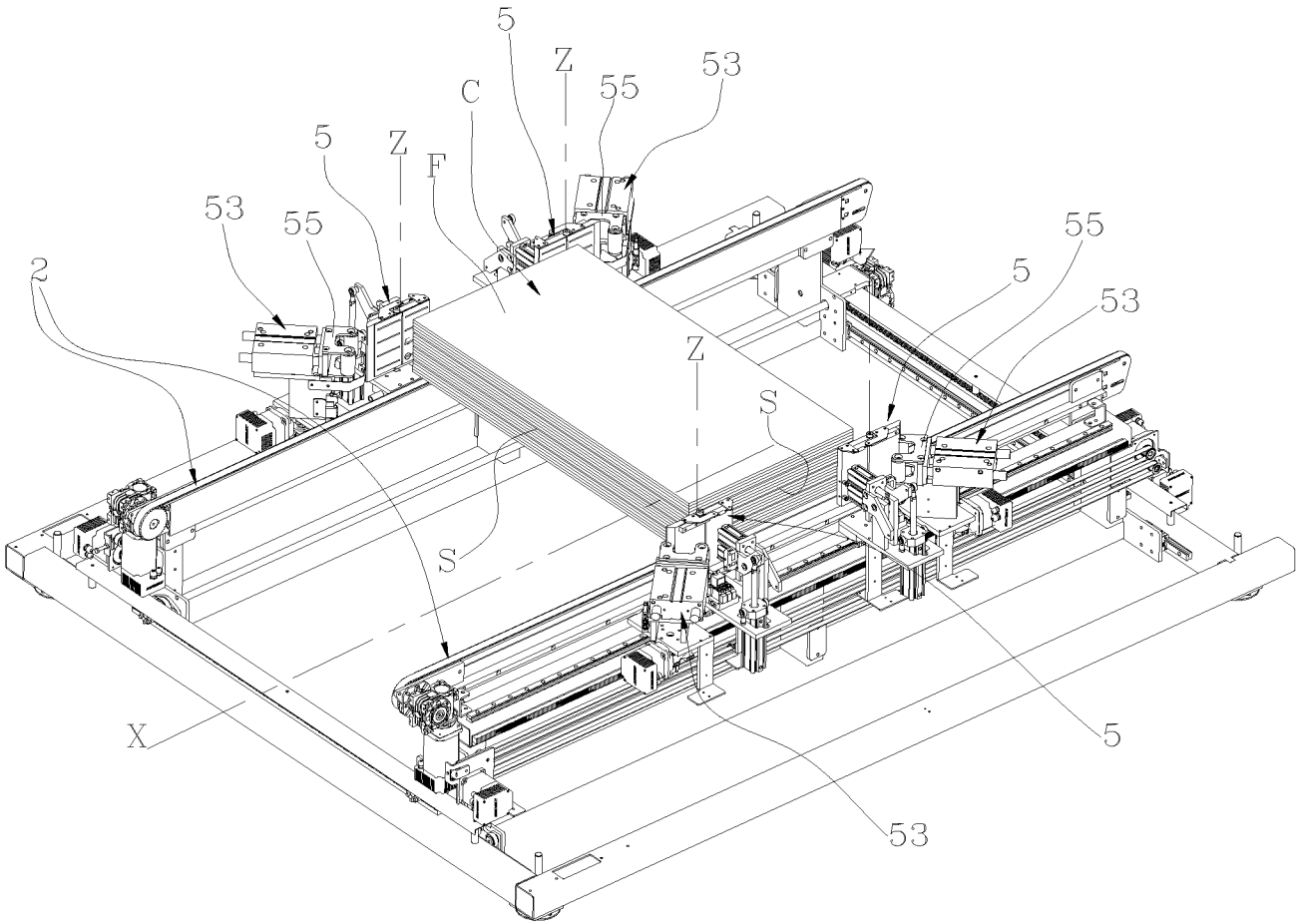
FIG. 3 shows the machine of FIG. 1 with some parts in a different operating configuration, and with some parts removed to better illustrate others.
Figure 4:
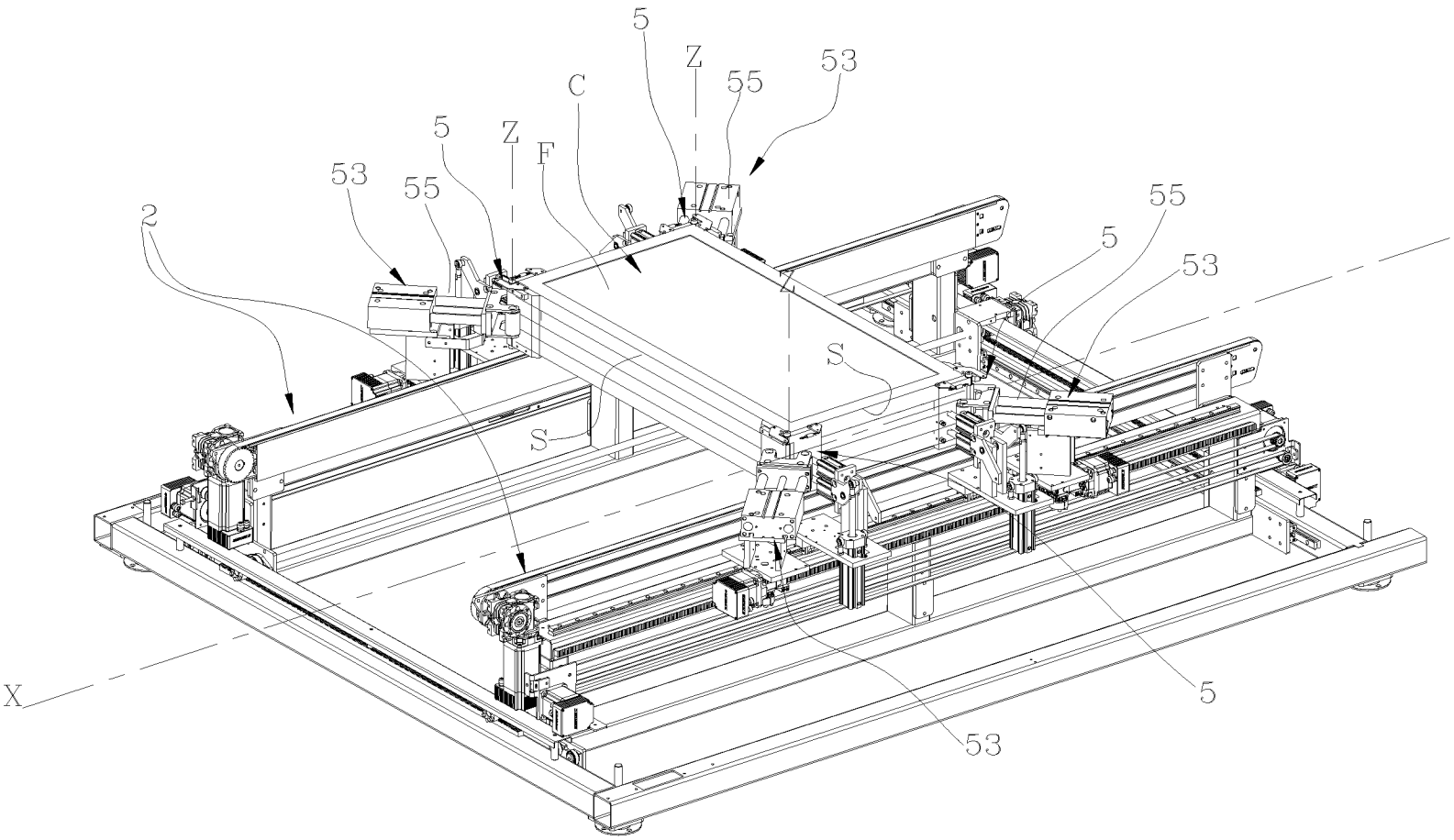
FIG. 4 shows the machine of FIG. 3 in a different operating configuration.
Figure 5:
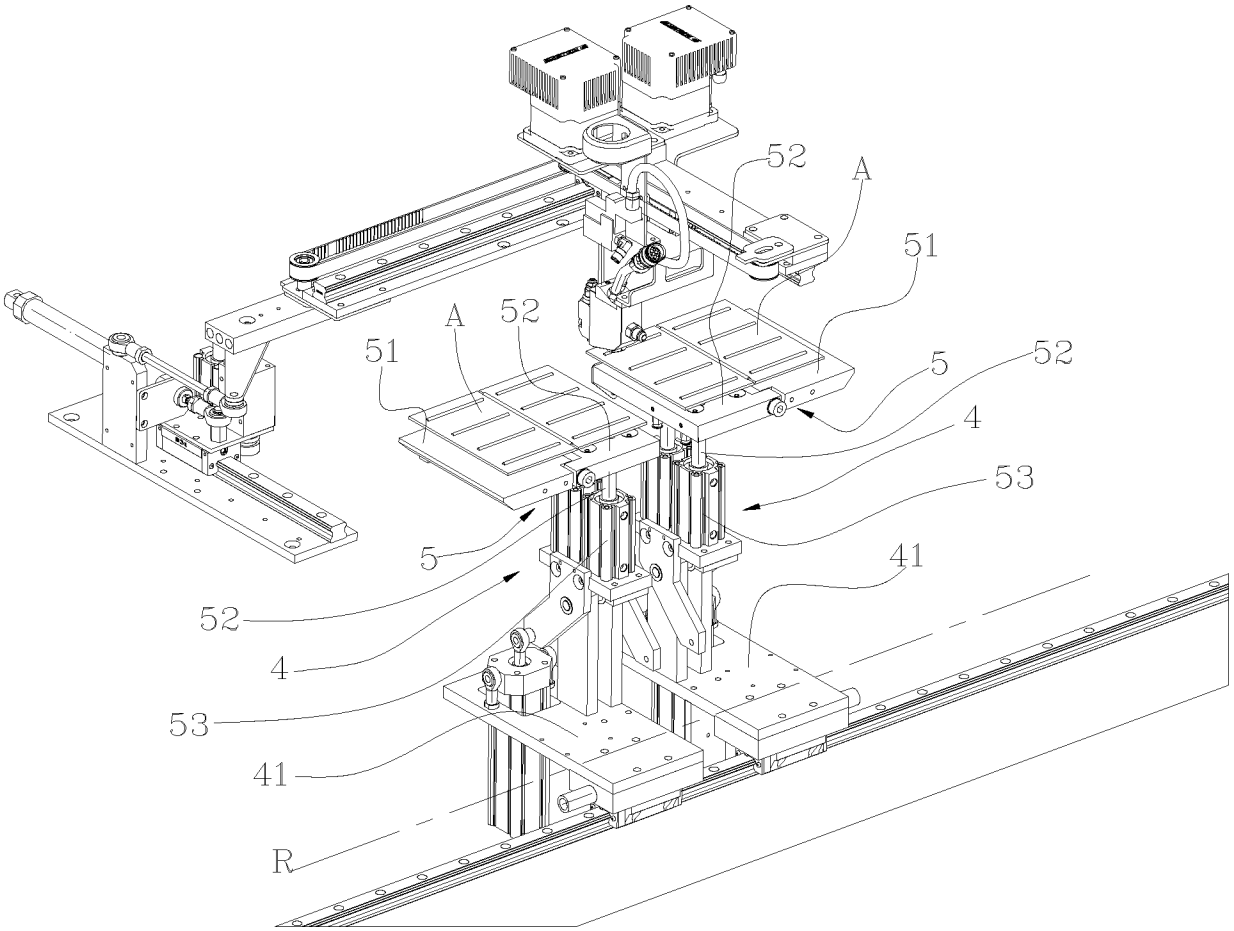
FIG. 5 illustrates some components of the machine according to the present invention.

Considering an initial configuration, illustrated in FIG. 2, in which the applicator (4) is in the pick up position, with the gripping plate (5) in the first position and the carriage (41) in the first position, the gripping plate (5) receives the connecting element (A). Thereafter, the carriage (41) slides into the second position and the gripping plate (5) rotates into the second position and is arranged in the distanced position, as shown in FIG. 3. In a following step, the gripping plate (5) moves from the distanced position to the approached position, applying the connecting element (A) to at least one flank (S) of the pack (C), as shown in FIG. 4.

In the illustrated preferred but not exclusive embodiment, the gripping plate (5) is movable between a flat configuration (FIGS. 2 and 3), in which it defines a substantially flat surface, and a folded configuration (FIG. 4), in which it defines an angled surface, suitable to superpose on two adjacent flanks (S) of the pack (C) and/or on a face (F) and a flank (S) of the pack.

In substance, in the folded configuration, the gripping plate (5) can be arranged straddling a corner (E) of the pack (C), and can position a connecting element (A) in contact with the two surfaces which meet at the corner (E), i.e. two adjacent flanks (S) or a face (F) and a flank (S). The connecting element (A), retained in contact with the gripping plate (5), folds concordantly with the gripping plate (5), and is thus able to be positioned straddling the corner (E).

In a possible preferred but not exclusive embodiment, the gripping plate (5) comprises a first portion (51) and a second portion (52) hinged to one another about an axis of rotation (Z). An actuator (53) is predisposed to exert a push on the first portion (51) and/or on the second portion (52), offset with respect to the axis of rotation (Z), which produces a rotation between the first portion (51) and the second portion (52) to define the folded configuration of the gripping plate (5), as shown in FIGS. 2 and 4.

In the illustrated embodiment, the actuator (53) comprises a rod (54) that is movable along an operating direction (T). The rod (54) is provided with a head (55) provided with two frontal protuberances that are positioned in such a way as to enter into contact with the first and the second portion (51,52) of the gripping plate (5). The rod (54) is movable between a retracted position, visible in FIG. 3, and an advanced position, visible in FIG. 4. In the advanced position, the head (55) sets in rotation at least one from between the first and second portion (51,52) about the axis of rotation (Z), by arranging the gripping plate (5) in the folded position, visible in FIG. 4.

In a possible embodiment, the actuator (53) might be solidly constrained to the gripping plate (5), i.e. to the carriage (41), following the displacements thereof. In the illustrated embodiment the actuator (53) is arranged in a fixed position, so as to enable its own push to be exerted on the gripping plate (5) at the moment when the latter is positioned to apply a connecting element (A).

In other terms, the actuator (53) is positioned in such a way as to be able to act on the gripping plate (5) when the latter and the carriage (41) are in the respective second position.

In a possible embodiment of the machine, the magazine (3) might contain connecting elements (A) dimensioned and conformed compatibly with a predetermined pack (C) of predefined dimensions and shape. In this case, on changing the shape and/or dimensions of the pack (C) it is necessary to predispose corresponding connecting elements (A).

In the illustrated preferred but not exclusive embodiment, the machine is predisposed to dimension the connecting elements (A) in real-time, i.e. to regulate at least one dimension of the connecting elements (A) in relation to the shape and/or dimensions of each pack (C) which is subsequently processed by the machine.

In particular, the magazine (3) comprises a first slider (31), provided with a suitable gripping means for gripping and releasing a connecting element (A), which is movable between a gripping position, in which it is able to grip a connecting element (A) contained in the magazine (3), and a release position, in which it arranges the connecting element (A) at least partially outside the magazine (3). In other terms, by means of the first slider (31) a connecting element (A) is partially extracted from the magazine (3), by sliding along an extraction direction (R) which is preferably horizontal.

In the illustrated embodiment, the first slider (31) is positioned below the magazine (3). The magazine (3) has a lower opening which enables the passage of one connecting element (A) at a time, drawn by the first slider (31) along the extraction direction.

The machine comprises a cutting device (6), predisposed to cut out the connecting element (A) to a predetermined size, as a function of the dimensions and/or the shape of the pack (C). In the illustrated embodiment, the cutting device (6) is located along the extraction direction (R) of the first slider (31).

The cutting device (6) is preferably interposed between the magazine (3) and the applicator (4), in order to cut out the connecting element (A), so that the applicator (4) can pick up, in the pick up position thereof, the connecting element (A) cut out to the predetermined size.

In the illustrated embodiment, the cutting device (6) comprises a blade (61) positioned to make a cut on a connecting element (A) retained in the release position of the first slider (31).

In substance, via the cutting device (6), the machine according to the present invention is able to cut to size the connecting elements (A), at least along a direction parallel to the extraction direction (R). In practice, with the dimension to be given to a connecting element (A) being known, the first slider (31) extracts the connecting element (A) by a portion having a corresponding length, along the extraction direction (R). The connecting element (A) is thus blocked and the cutting device (6) performs the cut. The cut portion of the connecting element (A) is then picked up by the gripping plate (5) for a subsequent application to a pack (C).

In the illustrated embodiment, the blade (61) is movable along at least a cutting direction (T1), along which it carries out the cut. The cutting direction (T1) is preferably perpendicular to the extraction direction (R). Preferably, but not necessarily, the blade (61) is also movable along an adjustment direction (T2), to enable the adjustment of the position of the blade (61) along at least the extraction direction (R). The further adjustment direction (T2) is preferably parallel to the extraction direction (R).

The functioning of the cutting device (6) is regulated by a control module which, on the basis of the dimensional and/or morphological characteristics of the pack (C), establishes a useful dimension for the connecting element (A) and consequently controls the travel performed by the first slider (31) and/or the position and/or the travel performed by the blade (61) at least along the adjustment direction (T2), if included. Further, the cutting device (6) can be used to realise a plurality of scores or weakening lines parallel on the connecting element (A). These scores are useful in facilitating the tearing-off of successive portions of the connecting element (A), so as to facilitate the pick up of a product from the pack. With the thickness of the products (P) forming the pack being known, the cutting device (6) can be activated so as to realise scores or weakened lines separated from one another by a distance equal to the thickness of the products (P), so that the scores or weakening lines are positioned between two adjacent products (P) of the pack.

Preferably, though not necessarily, the machine comprises a second slider (32), interposed between the cutting device (6) and the applicator (4) and movable between a gripping position, in which it is able to grip a connecting element (A) cut out by the cutting device (6), and a release position, in which it arranges the connecting element (A) in a position suitable to be picked up by the applicator (4) in the pick up position thereof.

Figure 6:
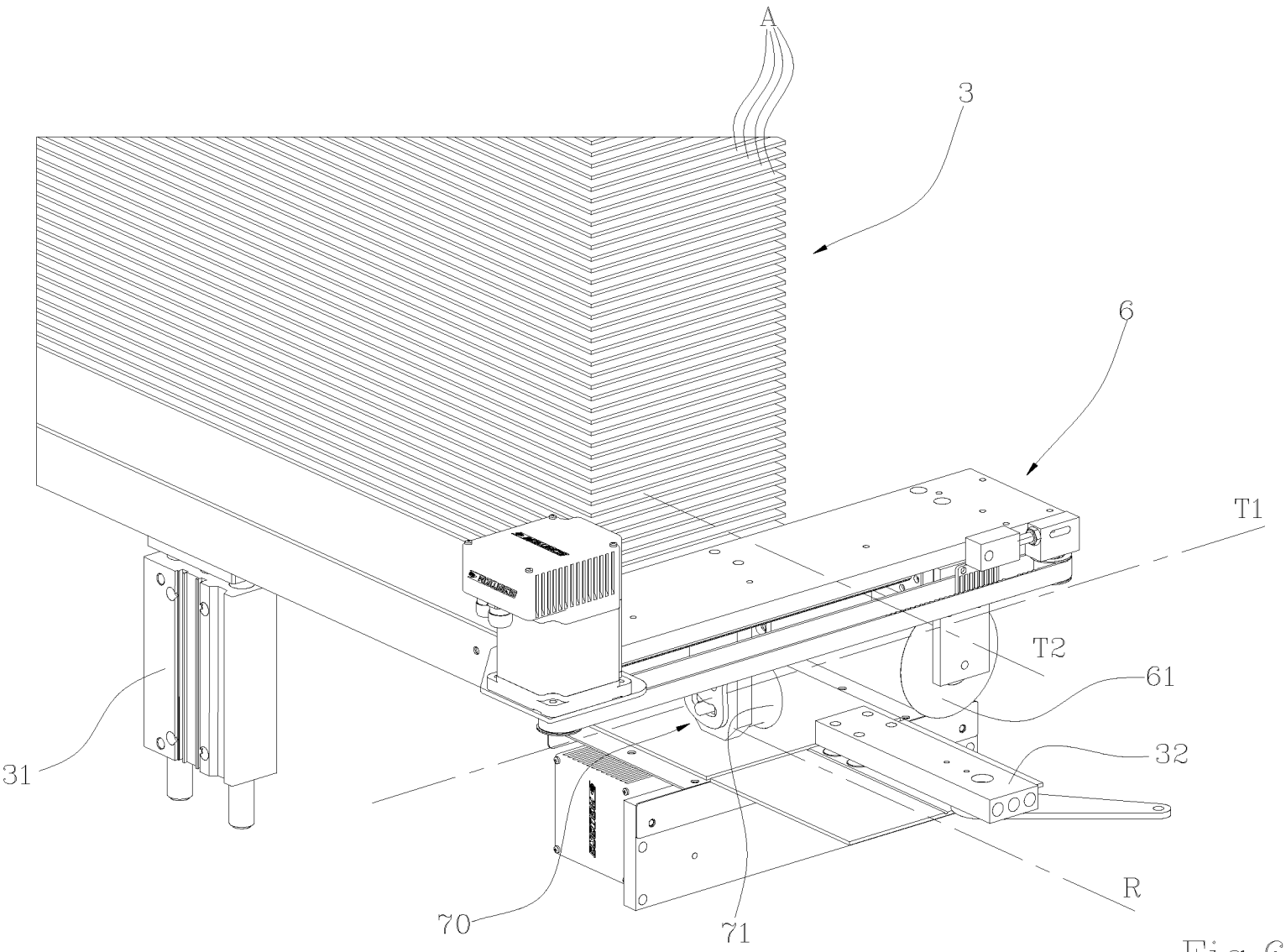
FIG. 6 shows the components of FIG. 5 from a different viewpoint.
Figure 7:
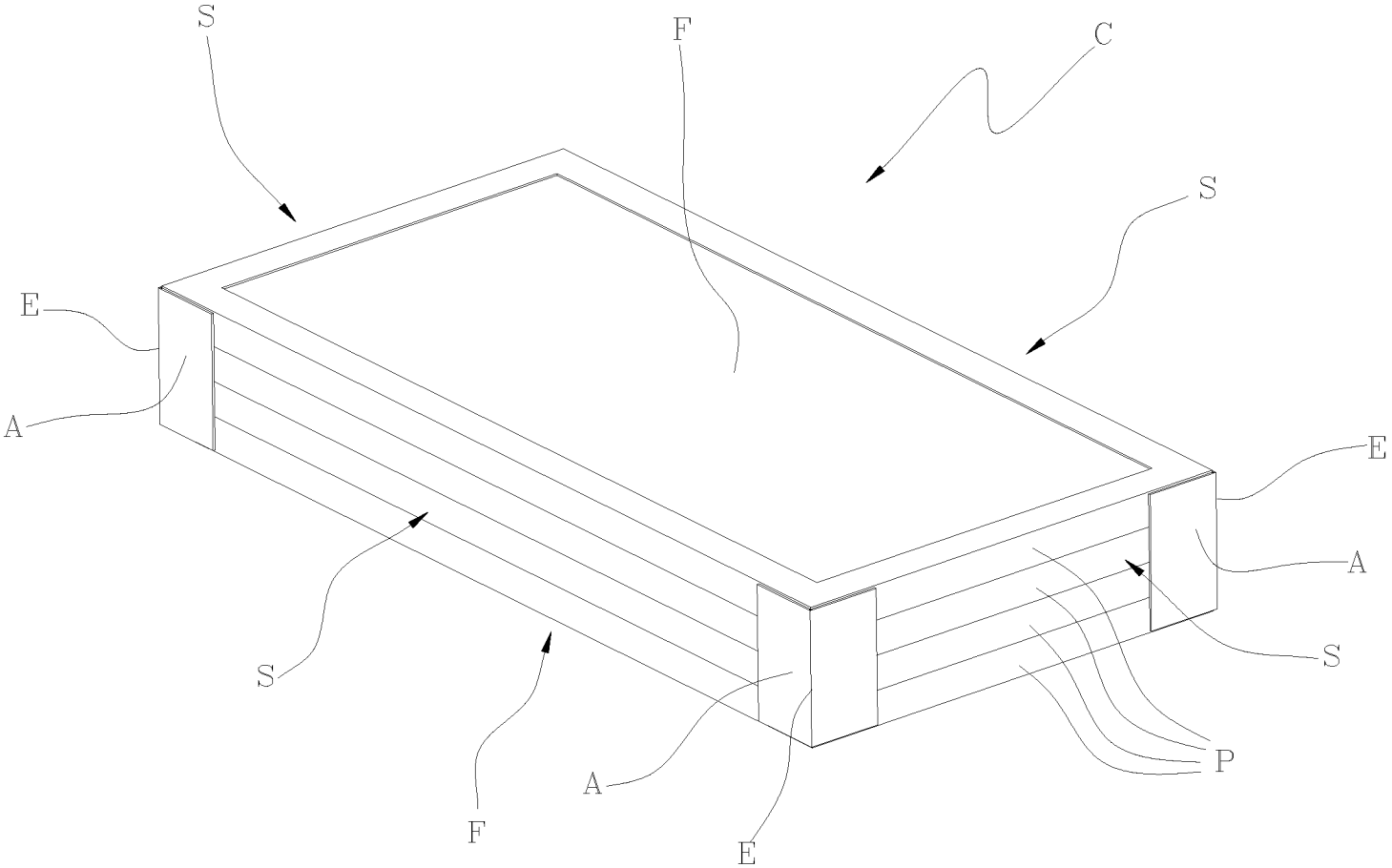
FIG. 7 shows a pack formed by a certain number of products, processable with the machine according to the present invention.

The second slider (32), particularly visible in FIG. 6, substantially performs the task of transferring the connecting element (A) from the cutting device (6) to the gripping plate (5). The second slider (32) is provided with a gripping means, for example one or more suction cups, configured to be able to retain and release, on command, a connecting element (A). The second slider (32) is movable in space, by means of actuators known to the expert in the sector, between a gripping position, located in such a way as to enable picking up a connecting element (A) already cut by the cutting means (6), and a release position, located in such a way as to proffer the connecting element to the applicator (4), and in particular to the gripping plate (5). The movement carried out by the second slider (32) can be defined as a function of the architecture of the machine, and in particular as a function of the relative position between the magazine (3) and the gripping position of the applicator (4). The use of the second slider (32) enables increasing the capability of relative positioning between the magazine and the gripping position of the applicator (4). In the illustrated embodiment, the gripping position of the applicator (4), defined by the first position of the carriage (41) and of the gripping plate (5) (FIG. 2) is located beneath the magazine (3) and in an advanced position, in the extraction direction from the magazine (3), along the extraction direction (R). The trajectory followed by the second slider (32) will then be orientated overall forward and downwards with respect to the extraction direction (R). Preferably, but not necessarily, the second slider (32) rotates the connecting element (A) by a right angle about an axis that is substantially horizontal.

In the event that the intervention of the cutting means (6) is not necessary, the second slider (32) is predisposed to pick up a connecting element (A) from the first slider (31).

Preferably, but not necessarily, the machine according to the present invention comprises a creasing device (70), predisposed to realise a creasing in the connecting element (A). The creasing facilitates the folding of the connecting element (A) at the corner (E) of the pack (C).

In the illustrated preferred but not exclusive embodiment, the creasing device (70) comprises a wheel (71), rotatable about a rotation axis that is substantially horizontal and perpendicular to the extraction direction (R).

Using an actuator unit known to the expert in the sector, the wheel (71) is pressed into contact with the connecting element (A) which rests on a lower abutment, not visible. Further, using the same actuator unit, or exploiting the extraction motion of the connecting element (A), a relative motion between the wheel (70) and the connecting element (A) takes place. This relative motion is directed parallel to the extraction direction (R).

The machine according to the present invention comprises a gluing device, predisposed to apply a predetermined quantity of glue on a determined zone of a connecting element (A) and/or of the pack (C), to facilitate adhesion of the connecting element (A) to the pack (C). The gluing device can be fixed or movable.

The gluing device is not illustrated and described in detail as it is well known in the sector.

The machine of the present invention is able to actuate a method for packaging a pack (C) of products (P), wherein the pack (C) has a parallelepiped conformation and comprises at least two faces (F) and four flanks (S).

The method comprises the following steps:

arranging the pack (C) on a rest plane (2), resting on a face (D) or on a flank (S);

applying at least one connecting element (A) on a flank (S) of the pack (C).

The connecting element (A) is preferably applied on the flank (S) of the pack (C) constrained to all the products (P) that form the pack (C).

The connecting element (A) is preferably constrained to all the products that form the pack (C) by gluing.

The step of applying at least one connecting element (A) on a flank (S) of the pack (C) preferably comprises the following steps:

picking up the connecting element (A) from a magazine (3);

cutting out the connecting element (A) to a predetermined size, as a function of the dimensions and/or the shape of the pack (C);

applying the connecting element (A) cut out to the predetermined size on the at least one flank (S) of the pack (C).

The step of applying at least one connecting element (A) on a flank (S) of the pack (C) preferably comprises applying the connecting element (A) straddling a corner (E) between two adjacent flanks (S) of the pack (C) or straddling a corner (E) between a face (F) and a flank (S) of the pack (C).

The pack (C) obtained by applying the above-described method, actuated by the machine according to the present invention, is thus formed by two or more products (P) approached to one another. As already illustrated, a product (P) has two main surfaces or faces (F), parallel to one another, and four lateral surfaces or flanks (S), lying on planes that are substantially perpendicular to the faces (F), which extend along the perimeter of the faces and join the faces to one another. The products (P) are approached to one another at the faces (F), with the flanks (S) arranged substantially aligned and coplanar between them so as to define the flanks (S) of the pack (C).

The products (P) thus-arranged form substantially a pack (C) which has two faces (F), defined respectively by the outer faces (F) of the products (P) at the ends of the pack (C), and four flanks (S), formed by the flanks (S) of the products (P) that are approached to one another. Two adjacent flanks (S) conjoin in corners (E), substantially perpendicular to the faces (F). Corners (E) are defined at the junctions between the faces (F) and each of the flanks (S).

The pack (C) comprises at least one connecting element (A) applied on a flank (S) of the pack (C).

The connecting element (A) is preferably constrained to all the products (P) that form the pack (C).

A connecting element (A) is preferably applied straddling a corner (E) between two adjacent flanks (S) of the pack (C).

A connecting element (A) is preferably applied straddling each corner of the pack (C).

The invention claimed is:

1. A packaging machine comprising:

a rest plane (2) for a pack (C) of products (P);

at least one magazine (3), predisposed to contain one or more connecting elements (A), predisposed to be applied to at least one flank (S) of the pack (C);

at least one applicator (4) configured to be movable between at least one pick up position in which the at least one applicator is configured to pick up a connecting element (A) of the one or more connecting elements from the magazine (3), and at least one application position in which the at least one applicator is configured to position the connecting element (A) of the one or more connecting elements in contact with the at least one flank (S) of the pack (C), wherein the applicator (4) comprises a gripping plate (5) activatable between a gripping configuration, in which the gripping plate is configured to retain the connecting element (A) of the one or more connecting elements, and a release configuration, in which the gripping plate is configured to release the connecting element (A) of the one or more connecting elements;

wherein the gripping plate (5) comprises a first portion (51) and a second portion (52) hinged to one another about an axis of rotation (Z); the gripping plate (5) is configured to be movable between a flat configuration, in which the first portion and the second portion define a substantially flat surface, and a folded configuration, in which the first portion and the second portion each define an angled surface, each angled surface being suitable to superpose on the at least one flank of two adjacent flanks (S) of the pack (C) and/or on at least one face (F) and the at least one flank (S) of the pack, wherein a pusher (53) is configured to contact and exert a thrust on both the first portion (51) and the second portion (52) of the gripping plate (5).

2. The machine according to claim 1, wherein:

the pusher (53) is configured to exert the thrust on both the first portion (51) and the second portion (52) at a location offset with respect to the axis of rotation (Z), a rotation between the first portion (51) and the second portion (52) is created to define the folded configuration of the gripping plate (5).

3. The machine according to claim 1, wherein the gripping plate (5) is configured to be movable between a distanced position, in which the gripping plate is situated at a predetermined distance from the pack (C), and an approached position, in which the gripping plate is substantially in contact with the at least one flank (S) of the pack (C) and in which the gripping plate is configured to apply the connecting element (A) of the one or more connecting elements to the at least one flank (S) of the pack (C).

4. The machine according to claim 1, wherein the gripping plate (5) is configured to be rotatable between a first position, in which the gripping plate faces towards the magazine (3) and is configured to grip and retain the connecting element (A) of the one or more connecting elements, and a second position, in which the gripping plate faces towards the pack (C).

5. The machine according to claim 1, wherein the magazine (3) comprises a first slider (31) configured to grip and release the connecting element (A) of the one or more connecting elements, wherein the first slider is configured to be movable between a gripping position, in which the first slider is configured to grip the connecting element (A) of the one or more connecting elements contained in the magazine (3), and a release position, in which the first slider is configured to arrange the connecting element (A) of the one or more connecting elements at least partially outside the magazine (3).

6. The machine according to claim 1, comprising a cutting device (6) configured to cut out the connecting element (A) of the one or more connecting elements to a predetermined size as a function of at least one dimension and/or a shape of the pack (C).

7. The machine according to claim 6, wherein the cutting device (6) is interposed between the magazine (3) and the applicator (4), wherein the cutting device is configured to cut out the connecting element (A) of the one or more connecting elements to the predetermined size so that the applicator, in the pick up position thereof, is configured to pick up the connecting element (A) of the one or more connecting elements cut out to the predetermined size.

8. The machine according to claim 6, comprising a second slider (32), interposed between the cutting device (6) and the applicator (4) and configured to be movable between a gripping position, in which the second slider is configured to grip the connecting element (A) of the one or more connecting elements cut out by the cutting device (6), and a release position, in which the second slider is configured to arrange the connecting element (A) of the one or more connecting elements in a position suitable to be picked up by the applicator (4) in the pick up position thereof.

9. A method for packaging the pack (C) of products using the packaging machine according to claim 1, wherein the pack (C) has a parallelepiped conformation and comprises two faces (F) and four flanks (S), comprising the following steps:

arranging the pack (C) on a rest plane (2), resting on one face of the two faces (F) of the pack (C) or on a first flank (S) of the four flanks of the pack (C);

applying the connecting element (A) of the one or more connecting elements on a second flank (S) of the four flanks of the pack (C).

10. The method according to claim 9, wherein the connecting element (A) of the one or more connecting elements is configured to be constrained to all the products which form the pack (C) by gluing.

11. The method according to claim 9, wherein the step of applying the connecting element (A) of the one or more connecting elements on the second flank (S) of the four flanks of the pack (C) comprises the following steps:

picking up the connecting element (A) of the one or more connecting elements from the at least one magazine (3);

cutting out the connecting element (A) of the one or more connecting elements to a predetermined size as a function of at least one dimension and/or a shape of the pack (C);

applying the connecting element (A) of the one or more connecting elements cut out to the predetermined size, to the second flank (S) of the four flanks of the pack.

12. The method according to claim 9, wherein the step of applying the one connecting element (A) of the one or more connecting elements on the second flank (S) of the four flanks of the pack (C) comprises applying the a connecting element (A) of the one or more connecting elements straddling a corner (E) between two adjacent flanks (S) of the four flanks of the pack (C) or straddling a corner (E) between one face (F) of the two faces and one flank (S) of the four flanks of the pack (C).

13. A pack (C) of products (P) prepared by the packaging machine according to claim 1, wherein the pack of products has two faces (F) and four flanks (S), wherein the four flanks (S) are defined by lateral surfaces of the products (P), and wherein the pack of products comprises a connecting element (A) of the one or more connecting elements, applied on at least one of the four flanks (S) of the pack (C).

14. The pack (C) according to claim 13, wherein the connecting element (A) of the one or more connecting elements is configured to be constrained to all the products (P) forming the pack (C).

* * * * *